US011448030B2

(12) United States Patent
Ewen et al.

(10) Patent No.: US 11,448,030 B2
(45) Date of Patent: Sep. 20, 2022

(54) OPEN WATER COILED TUBING SEALING DEVICE

(71) Applicant: Oceaneering International, Inc., Houston, TX (US)

(72) Inventors: Robert L. Ewen, Cypress, TX (US); Harris Akhtar Iqbal, Porter, TX (US)

(73) Assignee: Oceaneering International, Inc., Houston, TX (US)

( * ) Notice: Subject to any disclaimer, the term of this patent is extended or adjusted under 35 U.S.C. 154(b) by 0 days.

(21) Appl. No.: 16/895,048

(22) Filed: Jun. 8, 2020

(65) Prior Publication Data

US 2020/0362657 A1 Nov. 19, 2020

Related U.S. Application Data

(63) Continuation of application No. 16/038,453, filed on Jul. 18, 2018.

(60) Provisional application No. 62/534,333, filed on Jul. 19, 2017.

(51) Int. Cl.

| | |
|---|---|
| ***E21B 33/038*** | (2006.01) |
| ***E21B 33/076*** | (2006.01) |
| ***E21B 43/013*** | (2006.01) |
| ***E21B 19/00*** | (2006.01) |
| ***E21B 15/00*** | (2006.01) |

(Continued)

(52) U.S. Cl.

CPC ..... *E21B 33/0355* (2013.01); *E21B 19/22* (2013.01); *E21B 33/038* (2013.01); *E21B 33/076* (2013.01); *E21B 43/013* (2013.01)

(58) Field of Classification Search

None

See application file for complete search history.

(56) References Cited

U.S. PATENT DOCUMENTS

| | | | | |
|---|---|---|---|---|
| 7,431,092 | B2 * | 10/2008 | Haheim | E21B 33/076 166/85.1 |
| 8,863,846 | B2 * | 10/2014 | Overstreet | E21B 19/086 166/85.1 |
| 9,822,613 | B2 * | 11/2017 | Crawford | E21B 33/076 |

(Continued)

*Primary Examiner* — Matthew Troutman
*Assistant Examiner* — Douglas S Wood
(74) *Attorney, Agent, or Firm* — Maze IP Law, P.C.

(57) ABSTRACT

Dynamic/static sealing of coiled tubing subsea for pipeline and well access with hydrostatic conditions up to 10,000 feet water depth while maintaining wellbore or pipeline pressures up to 10,000 psi may be achieved using a system comprising a subsea fluid source which utilizes a riserless open water coiled tubing system and an open water coiled tubing sealer to control hydrostatic pressure and fluid container pressures. This comprises an upper well control assembly having a first geometric orientation and a lower well control assembly in fluid communication with the upper well control assembly aligned in a second geometric orientation substantially inverted to the first orientation; a quick disconnect connector in fluid communication with the upper well control assembly; one or more electrically powered subsea assist jacks operatively connected to the quick disconnect connector; a controller operatively in communication with the electrically powered subsea assist jacks; and a power connector operatively in communication with the source of electrical power, the controller, and the electrically powered subsea assist jack.

19 Claims, 3 Drawing Sheets

(51) Int. Cl.
*E21B 33/035* (2006.01)
*E21B 19/22* (2006.01)

(56) References Cited

U.S. PATENT DOCUMENTS

| | | | | |
|---|---|---|---|---|
| 9,874,065 | B2 * | 1/2018 | Christensen | E21B 17/01 |
| 2006/0201682 | A1 * | 9/2006 | Reynolds | E21B 33/038 166/368 |
| 2007/0227744 | A1 * | 10/2007 | Rodgers | E21B 19/22 166/85.1 |

* cited by examiner

OPEN WATER COILED TUBING SEALING DEVICE

RELATION TO PRIOR APPLICATIONS

This application is a continuation in part of U.S. Provisional application Ser. No. 16/038,453, filed Jul. 18, 2018, and claims priority through U.S. Provisional Application 62/534,333, filed Jul. 19, 2017.

BACKGROUND

This invention relates to coiled tubing being utilized to intervene in a pipeline or well subsea while maintaining pressure integrity from the hydrostatic and dynamic conditions.

In a subsea environment, performing an intervention with coiled tubing to a pipeline, or oil/gas well historically used a semi-submersible rig or DP Monohull vessel with a riser conduit from surface to the subsea tree or pipeline.

When utilizing a riser or flexible conduit the pressure control equipment (such as blow out preventers (BOP's) and stripper assemblies) are mounted at surface to control any release of fluids or gases from the well/pipeline during the intervention program.

However, when operating riserless conduits utilizing open water coiled tubing (OWCT), the well control package including the strippers for dynamic control have to be modified to operate subsea and control both hydrostatic and wellbore conditions simultaneously.

Normally this equipment is hydraulically controlled to function subsea. Methods are needed for dynamic/static sealing of coiled tubing subsea for pipeline and well access with hydrostatic conditions up to 10,000 ft water depth while maintaining wellbore or pipeline pressures up to 10,000 psi. Current systems exist for surface application only and seal coiled tubing from wellbore or pipeline pressure with only ambient pressure at surface.

DRAWINGS

Various figures are included herein which illustrate aspects of embodiments of the disclosed inventions.

BRIEF DESCRIPTION OF EXEMPLARY EMBODIMENTS

Figure 1:
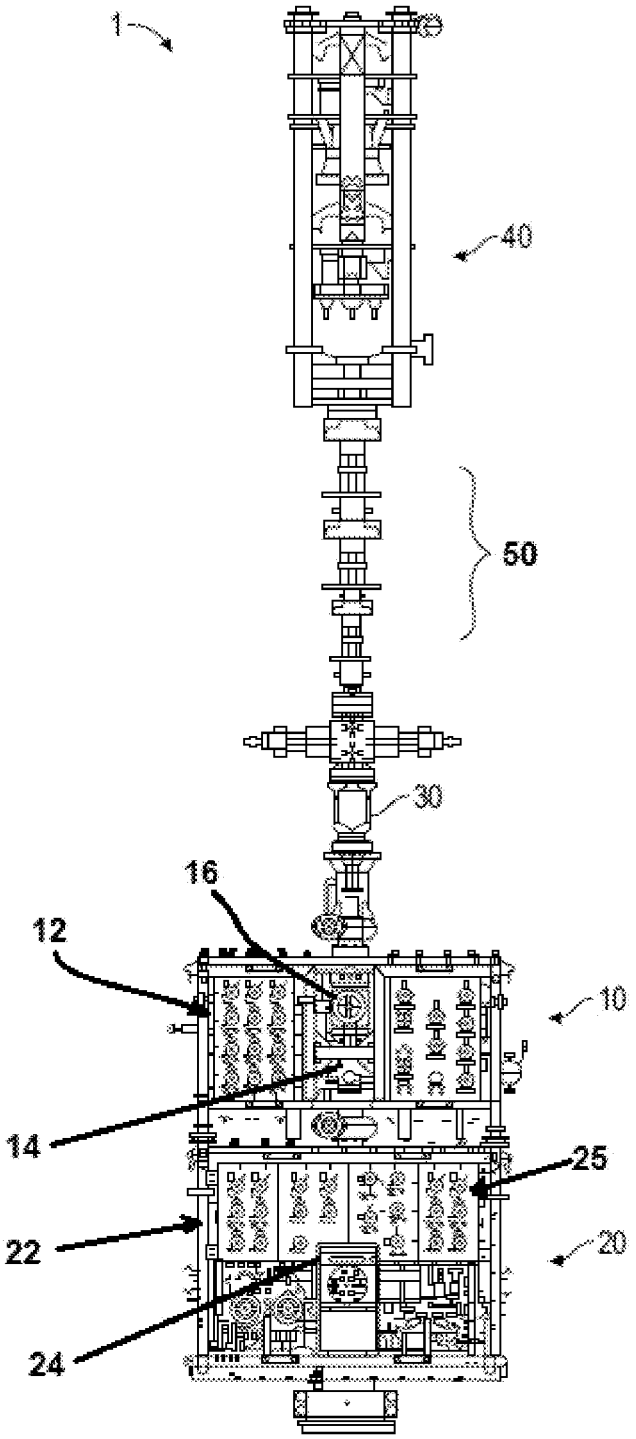
FIG. 1 is a view in partial perspective of a first exemplary system.

Referring now to FIG. 1, open water coiled tubing sealer 1, useful to control hydrostatic pressure and fluid container pressures, comprises upper well control assembly 10, comprising a first geometric orientation; lower well control assembly 20 in fluid communication with upper well control assembly 10, where lower well control assembly 20 comprises a second geometric orientation substantially inverted to the first orientation; and quick disconnect connector 30 in fluid communication with upper well control assembly 10. As used herein a fluid container is a wellbore, a pipeline, or the like.

In typical embodiments, open water coiled tubing sealer 1 further comprises one or more electrically powered subsea assist jacks 40 which are operatively connected to quick disconnect connector 30 and a controller operatively in communication with the electrically powered subsea assist jack. Previously this equipment was to be hydraulically controlled (which is the industry norm). Typically, electrically powered subsea assist jacks 40 are controlled using three phase electric power and electric motors with a feedback loop of electronic communication over a power connector which may comprise or otherwise interface with umbilical 110 or the like. Thus, instead of hydraulic motors driving the jack cylinders, these would be replaced with electric motors utilizing a power convertor operatively in communication with the power connector to handle the speed and direction through a main umbilical, such as umbilical 110, to subsea fluid source 100 which may be part of a subsea control skid.

The same thing could be done with one or more slip bowls, i.e. electric motors could replace hydraulic motors to activate and de-activate the slips. One or more electronic sensors, which can comprise proximity switches or similar equipment, can be utilized to provide feedback for control such as for closing and opening the slip bowls along with one or more position sensors to provide feedback on the position of the cylinders/roller bearing screw jacks, e.g. electrically powered subsea assist jacks 40, which are operatively connected to the electric motors.

Fluid power and electrical communication for the open water coiled tubing sealer may be delivered through umbilical 110.

In certain embodiments open water coiled tubing sealer 1 further comprises one or more packers 50, understood to be coiled tubing packers, disposed intermediate electrically powered subsea assist jacks 40 and quick disconnect connector 30.

Typically, upper well control assembly 10 comprises a plurality of control assist assemblies 12. Similarly, lower well control assembly 20 may also comprise a plurality of control assemblies 22 which may be the same as or similar to control assist assemblies 12. Where upper well control assembly 10 comprises the plurality of control assist assemblies 12, these may be arranged into pairs, which may be arranged redundantly and/or cooperatively or the like. Similarly, where lower well control assembly 20 comprises the plurality of control assist assemblies 22, these may also be arranged into pairs, which may be arranged redundantly and/or cooperatively or the like.

Upper well control assembly 10 may further comprise one or more inverted strippers 14, where these are understood to be coiled tubing strippers. Upper well control assembly 10 may also further comprise one or more packers 16, which may comprise a packer assembly as that term is familiar to one of ordinary skill in these arts. Such packers 16 or packer assemblies 16 may be or otherwise comprise subsea replaceable packer assemblies 16 or replacement components such as packer 25.

Figure 2:
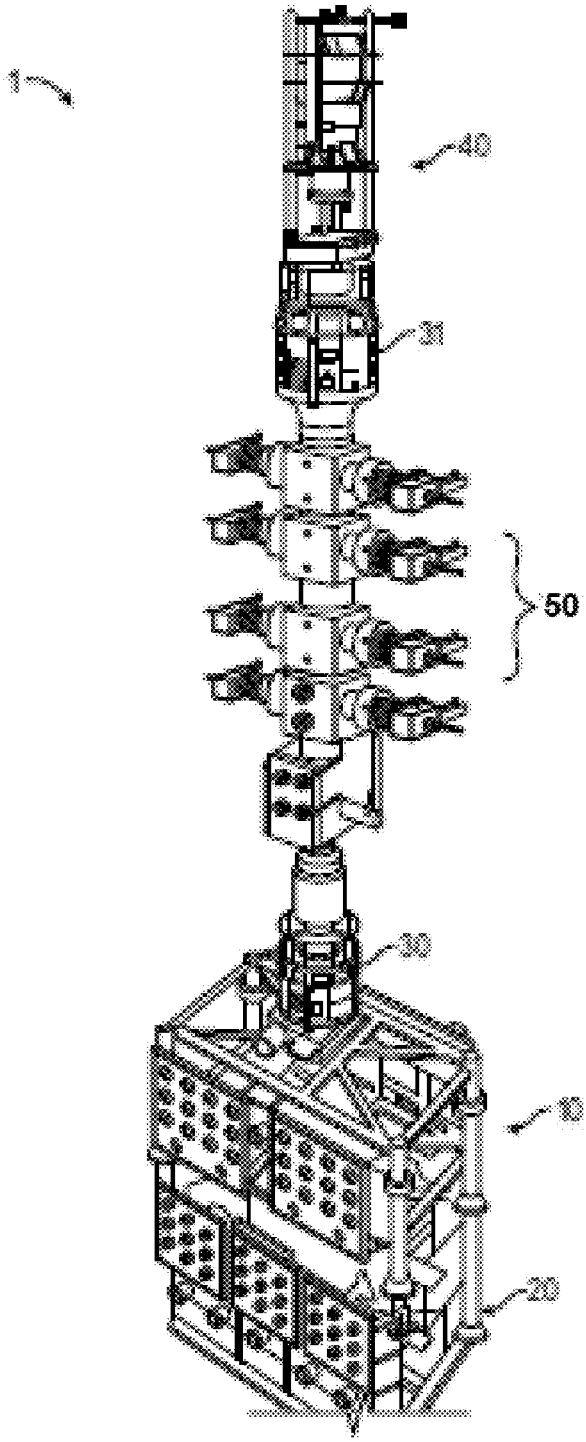
FIG. 2 is a second in partial perspective of a second exemplary system.
Figure 3:
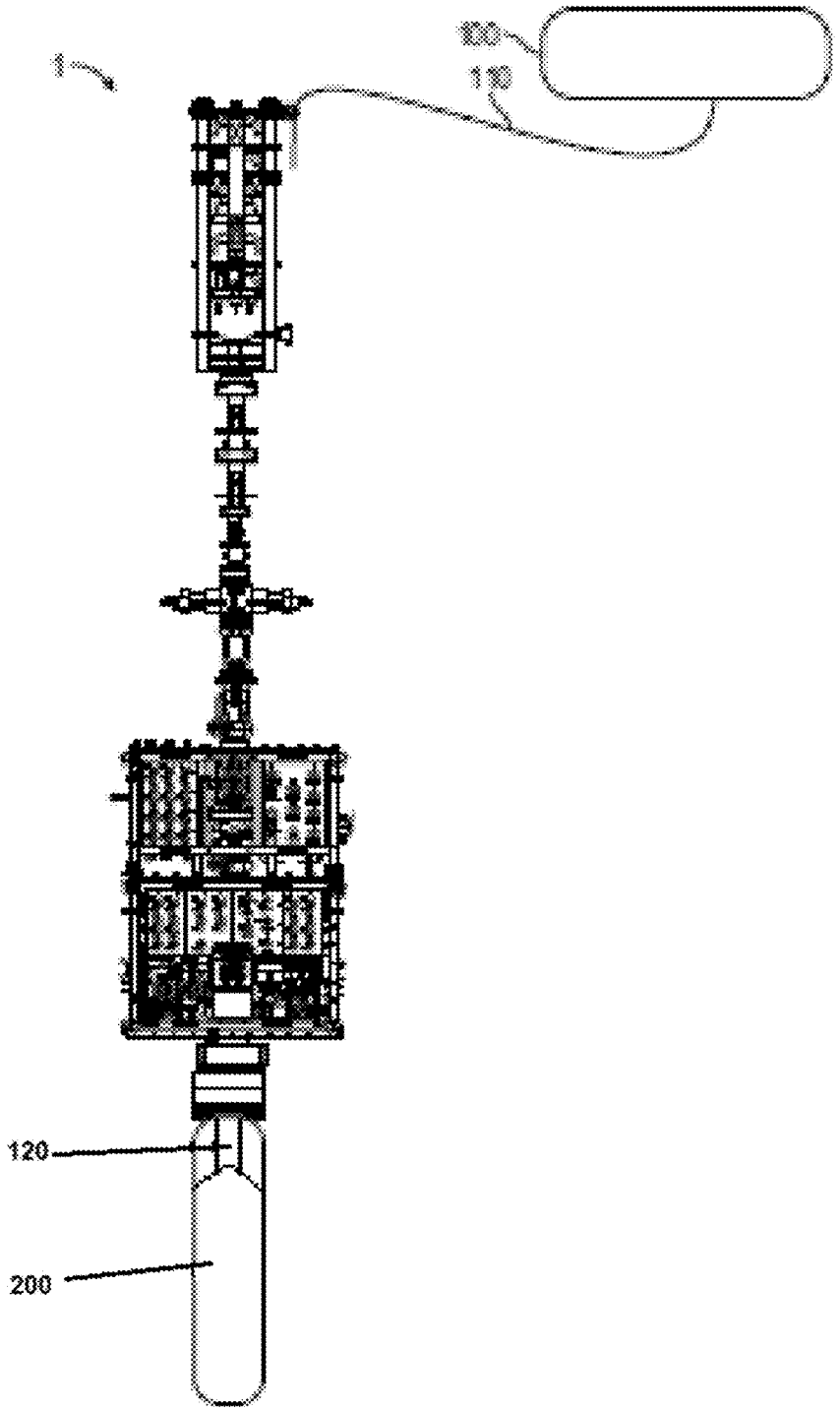
FIG. 3 is a view in partial perspective of an exemplary system showing a fluid source.

As illustrated in FIGS. 1 and 2, quick disconnect connector 30 may be located intermediate strippers 14 and upper well control assembly 10 and a second quick disconnect connector, quick disconnect connector 31 (FIG. 2) may be optionally present and located intermediate electrically powered subsea assist jacks 40 and strippers 14.

Similarly, lower well control assembly 20 may comprise one or more strippers 24. As with upper well control assembly 10, lower well control assembly 20 may also further comprise one or more packer elements 26 which may be other or otherwise comprise a subsea replaceable packer.

In the operation of exemplary embodiments, hydrostatic pressure and fluid container pressures may be controlled utilizing riserless open water coiled tubing system 1. In general, the method comprises operatively connecting strippers 14, as described above, to subsea fluid source 100 and quick connectors 30,31. The arrangement and orientation of strippers 14 and packers 50 allow hydrostatic and wellbore (or pipeline) pressures to be dynamically contained around coiled tubing as subsea assist jack 40 pushes the coiled tubing in and out of wellbore 200.

Hydrostatic pressure due to a water depth of up to around 10000 feet, or up to a first pressure of around 4500 psi, may be contained using strippers 14 in their arranged orientation. Further, fluid container pressure ranging from around zero to around 10000 psi may be contained substantially simultaneously. This helps ensure bi-directional sealing of both hydrostatic and fluid container pressures during operation.

Where open water coiled tubing sealer 1 comprises a plurality of packer assemblies 16 with hydrostatic control assist and lower well assembly 20 comprises a plurality of packer units 25 which are adapted for assisting well control, annular cavities that exist between strippers 14 can be pressurized using hydraulic porting such as with externally supplied hydraulic pressure and/or utilizing hydro-cushion accumulators to ensure minimized differential pressures across packer 50 and/or packer 16 which can help increase wear life of these packers. The externally supplied hydraulic pressure may be supplied via an umbilical such as umbilical 110 which can carry fluid from a surface supply or via subsea accumulation.

Open water coiled tubing sealer 1 may further comprise subsea fluid source 100 such as a monoethylene glycol (MEG) fluid source or the like. In embodiments, the method may further comprise controlling the hydrostatic and/or fluid container pressures using pairs of strippers 14 with full backup to provide redundancy for containment of both hydrostatic and/or fluid container pressures. In general, backup is related to the number of strippers 14 that are dedicated to each pressure direction, e.g. hydrostatic and/or fluid container. By way of example and not limitation, FIG. 1 illustrates three strippers 14: one dedicated for hydrostatic pressure at top, one for fluid container pressure at bottom, and one in the middle which can be arranged to serve as a back for hydrostatic containment or fluid containment in the fluid container. By way of further example, FIG. 2 illustrates four strippers 14: the top two (a set or pairs) serving as containment devices for hydrostatic pressure with only one in the set active while the other serves as a backup for hydrostatic and the bottom two (a set or pairs) serving as containment devices for wellbore pressure with only in that set being active while the other serves as a backup for wellbore pressure. This can enable the containment/sealing of the hydrostatic pressure with the upper pair of strippers 14 (and/or packer assemblies 16) and the containment/sealing of the wellbore pressure with the lower pair of strippers 14 (and/or packer assemblies 16). In embodiments, full backup comprises using two or more strippers 14 (and/or packer assemblies 16) dedicated per set (each set being containment for either hydrostatic or fluid container pressures).

In embodiments, strippers 14 may be replaced subsea, thereby allowing continuous operations without pulling open water coiled tubing sealer 1 back to surface to replace the packers.

It is noted that although various arrangements can be used, the basic arrangement is a first stripper/packer arranged in a first position relative to fluid flow and a second stripper/packer, essentially the same or similar to the first stripper/packer, fluidly coupled to the first stripper/packer but inverted with respect the first stripper/packer alignment. This can entail a plurality of each such stripper/packer units, e.g. two first stripper/packer assemblies with hydrostatic pressure control/containment and one or more second stripper/packer units for fluid container control/containment with hydro-cushions and/or external hydraulic pressure to pressurize the annular cavities between the dual sets of strippers 14. By doing this, hydrostatic pressure is enabled to assist sealing the upper stripper/packers and the wellbore pressure to assist sealing the lower stripper/packers. It has been found that adding additional stages as described herein, splitting them into pairs, and then inverting one pair from the other provides additional redundancy as needed by the operation.

As opposed to current systems for only surface application and seal coiled tubing from wellbore or pipeline pressure with only ambient pressure at surface, using the methods described above, dynamic/static sealing of coiled tubing subsea, such as for pipeline and well access, may be accomplished with hydrostatic conditions of up to around 10,000 ft water depth while maintaining wellbore or pipeline pressures up to around 10,000 psi. It is noted that coiled tubing is actually moving in/out of wellbore 200 through the whole system, and therefore sealing by strippers 14 is a dynamic seal when the coiled tubing is moving up/down. As opposed to current systems, it can be seen that the claimed system may be used at depth in water and as such the hydrostatic pressure may be up to around 4,500 psi (10,000 ft water depth equivalent) versus just 14.7 psi or ambient air (1 atm) pressure at surface in current systems, in part because the arrangement and orientation of strippers 14 provide pressure control/containment against the higher hydrostatic pressure due to being at the bottom of the ocean.

The foregoing disclosure and description of the inventions are illustrative and explanatory. Various changes in the size, shape, and materials, as well as in the details of the illustrative construction and/or an illustrative method may be made without departing from the spirit of the invention.

What is claimed is:

1. An open water coiled tubing sealer to control hydrostatic pressure and fluid container pressures, comprising:

a. an upper well control assembly having a first geometric orientation about a first longitudinal axis defined through a center of the upper well control assembly and comprising a first predefined set of elements disposed within the upper well control assembly in a first alignment about the first longitudinal axis, the first predefined set of elements comprising:
   1. a first control assist assembly;
   2. a first stripper; and
   3. a first packer;

b. a lower well control assembly in fluid communication with the upper well control assembly, the lower well control assembly comprising a second geometric orientation substantially inverted with respect to the first orientation about a second longitudinal axis defined through a center of the lower well control assembly and extending longitudinally from the first longitudinal axis and comprising a second predefined set of elements disposed within the lower well control assembly in a first alignment about the second longitudinal axis, the second predefined set of elements comprising:
   1. a second control assist assembly;
   2. a second stripper; and
   3. a second packer;

c. a first quick disconnect connector disposed intermediate the first second stripper and the upper well control assembly, the first quick disconnect connector in fluid communication with the upper well control assembly;

d. an electrically powered subsea assist jack operatively connected to the first quick disconnect connector, the electrically powered subsea assist jack comprising:
   i. an electric motor; and
   ii. a power convertor operatively in communication with the electric motor;
e. a second quick disconnect connector disposed between the second stripper and the electrically powered subsea assist jack;
f. a controller operatively in communication with the electrically powered subsea assist jack; and
g. a power connector operatively in communication with a source of electrical power, the controller, the electric motor, and the electrically powered subsea assist jack.

2. The open water coiled tubing sealer to control hydrostatic pressure and fluid container pressures of claim 1, wherein the controller further comprises:
a. a feedback loop adapted to provide data communication over the power connector;
b. an electronic sensor; and
c. a position sensor operatively in communication with the electrically powered subsea assist jack and operative to provide feedback on a position of an internal element of the electrically powered subsea assist jack.

3. The open water coiled tubing sealer to control hydrostatic pressure and fluid container pressures of claim 1, further comprising a third stripper disposed proximate a middle of the open water coiled tubing sealer and configured to serve as a backup for hydrostatic containment or fluid containment in the fluid container.

4. The open water coiled tubing sealer to control hydrostatic pressure and fluid container pressures of claim 3, wherein the first packer or the second packer comprises a subsea replaceable packer.

5. The open water coiled tubing sealer to control hydrostatic pressure and fluid container pressures of claim 1, wherein:
a. the first stripper comprises a first pair of strippers configured to serve as containment devices for hydrostatic pressure with a first stripper of the first pair of strippers is active while the second stripper of the first pair of strippers is configured to serve as a backup for hydrostatic pressure; and
b. the second stripper comprises a second pair of strippers configured to serve as containment devices for wellbore pressure with a first stripper of the second pair of strippers is active while the second stripper of the second pair of strippers is configured to serve as a backup for wellbore pressure.

6. The open water coiled tubing sealer to control hydrostatic pressure and fluid container pressures of claim 1, wherein each of the first stripper and the second stripper comprises a subsea replaceable stripper.

7. The open water coiled tubing sealer to control hydrostatic pressure and fluid container pressures of claim 1, wherein the first control assist assembly comprises a plurality of control assist assemblies.

8. The open water coiled tubing sealer to control hydrostatic pressure and fluid container pressures of claim 1, wherein the second control assist assembly comprises a plurality of control assist assemblies.

9. The open water coiled tubing sealer to control hydrostatic pressure and fluid container pressures of claim 1, wherein:
a. the upper well control assembly comprises a plurality of control assist assemblies arranged into pairs; and
b. the lower well control assembly comprises a plurality of control assist assemblies arranged into pairs.

10. The open water coiled tubing sealer to control hydrostatic pressure and fluid container pressures of claim 1, wherein the second control assist assembly is identical to the first control assist assembly.

11. The open water coiled tubing sealer to control hydrostatic pressure and fluid container pressures of claim 1, further comprising a skid-based source of electrical power operatively in communication with the power connector.

12. A method for controlling hydrostatic pressure and fluid container pressures in a system that comprises a subsea fluid source which utilizes a riserless open water coiled tubing system and an open water coiled tubing sealer to control hydrostatic pressure and fluid container pressures comprising an upper well control assembly having a first geometric orientation about a first longitudinal axis relative to fluid flow through a center of the upper well control assembly and comprising an upper well control assist assembly comprising a first stripper and a first packer; a lower well control assembly in fluid communication with the upper well control assembly and comprising a lower well control assist assembly arranged in a second geometric orientation substantially inverted with respect to the first orientation about a second longitudinal axis defined through a center of the lower well control assembly and substantially extending from the first longitudinal axis, the lower well control assembly comprising a second stripper and a second packer, the lower well control assembly fluidly coupled to the upper well control assembly; a quick disconnect connector in fluid communication with the upper well control assembly; an electrically powered subsea assist jack operatively connected to the quick disconnect connector and comprising an electric motor, a power connector operatively in communication with the electric motor, and a power convertor operatively in communication with the electric motor; a controller operatively in communication with the electrically powered subsea assist jack; and a power connector operatively in communication with a source of electrical power, the controller, and the electrically powered subsea assist jack; the method comprising:
a. operatively connecting the first and second strippers to a subsea fluid source in an inverted relationship to each other along an axis defined by a fluid flow conduit;
b. using an electrically powered subsea assist jack to move coiled tubing with respect to an interior portion of a wellbore by having the electrically powered subsea assist jack maneuver the coiled tubing into and out from the wellbore; and
c. using an operation of the first and second strippers and the first and second packers as arranged to dynamically contain hydrostatic and wellbore pressure around the coiled tubing while the subsea assist jack is moving the coiled tubing with respect to the wellbore.

13. The method of claim 12, wherein the first and second strippers define an annular cavity there between and using the arrangement of the first and second strippers and the first and second packers to dynamically contain hydrostatic and wellbore pressure around the coiled tubing while the subsea assist jack is moving the coiled tubing with respect to the wellbore further comprises:
a. using one of the well control assemblies control and/or contain hydrostatic pressure via the arrangement of the first and second strippers as they operate and the first and second packers as they operate;
b. using the other of the well control assemblies to control and/or contain fluid container pressure via the arrangement of the first and second strippers as they operate and the first and second packers as they operate; and c. using a hydro-cushion accumulator to pressurize the annular cavity between the first and second strippers.

14. The method of claim 12, wherein the strippers are pressurized using hydraulic porting via an externally supplied hydraulic pressure or via utilizing a hydro-cushion accumulator to ensure a predetermined differential pressure across packer elements.

15. The method of claim 14, wherein externally supplied hydraulic pressure is supplied via an umbilical configured to carry fluid from a surface supply or via subsea accumulation.

16. The method of claim 15, wherein:

a. the subsea fluid source comprises a monoethylene glycol fluid; and b. controlling the hydrostatic and wellbore pressure further comprises using pairs of strippers to provide redundancy for containment of hydrostatic pressures, fluid container pressures, or both hydrostatic and fluid container pressures by having a second stripper of the pair of strippers take over functionality provided by a first stripper of the pair of strippers in the event of failure of the first stripper of the pair of strippers.

17. The method of claim 15, wherein backup is provided by having:

a. the first stripper comprises a first pair of strippers configured to serve as containment devices for hydrostatic pressure with a first stripper of the first pair of strippers being active while the second stripper of the first pair of strippers is configured to serve as a backup for hydrostatic pressure if the first stripper of the first pair of strippers fails; and b. the second stripper comprises a second pair of strippers configured to serve as containment devices for wellbore pressure with a first stripper of the second pair of strippers is active while the second stripper of the second pair of strippers is configured to serve as a backup for wellbore pressure if the first stripper of the second pair of strippers fails.

18. The method of claim 12, further comprising:

a. enabling hydrostatic pressure to assist sealing the upper well control assembly further comprises providing hydrostatic pressure of up to a first pressure of around 4500 psi; and b. the predetermined amount of hydrostatic pressure comprises fluid pressures from zero to around 10000 psi.

19. The method of claim 12, further comprising:

a. using an electronic sensor to obtain electrically sensed data and provide the electrically sensed data to the controller; and b. using a position sensor to obtain data related to a position of a predetermined component of the electrically powered subsea assist jack and provide feedback to the controller comprising the data on the position of the predetermined component of the electrically powered subsea assist jack.

* * * * *